United States Patent [19]

Stark et al.

[11] 4,088,260

[45] May 9, 1978

[54] PARALLELEPIPEDIC PACKING CONTAINER TOGETHER WITH A METHOD FOR ITS MANUFACTURE

[75] Inventors: Olof S. Stark, Rydsgård; Kjell H. Mårtensson, Malmö, both of Sweden

[73] Assignee: AB Ziristor, Lund, Sweden

[21] Appl. No.: 688,997

[22] Filed: May 24, 1976

[30] Foreign Application Priority Data

May 29, 1975 Sweden ..... 7506126

[51] Int. Cl.[2] ..... B65D 5/72; B65D 31/12

[52] U.S. Cl. ..... 229/17 R; 229/55

[58] Field of Search ..... 229/17 R, 7 R, 7 S, 229/55, 22

[56] References Cited

U.S. PATENT DOCUMENTS

| | | | |
|---|---|---|---|
| 1,633,296 | 6/1927 | Tooker et al. | 229/55 |
| 2,061,437 | 11/1936 | Potdevin | 93/19 X |
| 2,892,580 | 6/1959 | Williams | 229/55 |
| 3,365,116 | 1/1968 | Ludlow | 229/55 |
| 3,529,765 | 9/1970 | Wemlinger | 229/55 X |
| 3,552,631 | 1/1971 | Fuchs | 229/7 R |

FOREIGN PATENT DOCUMENTS

| | | |
|---|---|---|
| 324,132 | 5/1970 | Sweden. |
| 324,986 | 6/1970 | Sweden. |
| 1,012,867 | 12/1965 | United Kingdom. |

*Primary Examiner*—Stephen P. Garbe
*Attorney, Agent, or Firm*—Burns, Doane, Swecker & Mathis

[57] ABSTRACT

Parallelepipedic packing containers are made and filled in succession by passing a continuous web of packaging material over a forming device which converts the web into tubular form with an overlapped longitudinal seam. The tube is then filled with the intended contents, e.g., a liquid and is then divided off into individual packing containers by first pressing the tube transversely at longitudinally spaced intervals along broad zones and the opposite sides of the flattened tube are heat-sealed to each other along two narrow sealing regions close to the opposite base lines of the flattened zone while the remaining portions of the flattened zone remain non-sealed. The filled portion of the packing container between successive flattened zones is then reformed into the desired parallelepipedic shape, and the packages are then separated from each other by cutting through the non-sealed portion of the flattened zones thus leaving fins which are then folded down against the opposite side walls of the container to stiffen and reinforce the same. The cutting of the double-walled, non-sealed flattened zone is done quite closely to the narrow sealing regions and in such manner that the fins formed on each package have a single material thickness along substantially the full length of the sealing regions.

4 Claims, 4 Drawing Figures

PARALLELEPIPEDIC PACKING CONTAINER TOGETHER WITH A METHOD FOR ITS MANUFACTURE

Figure 1:
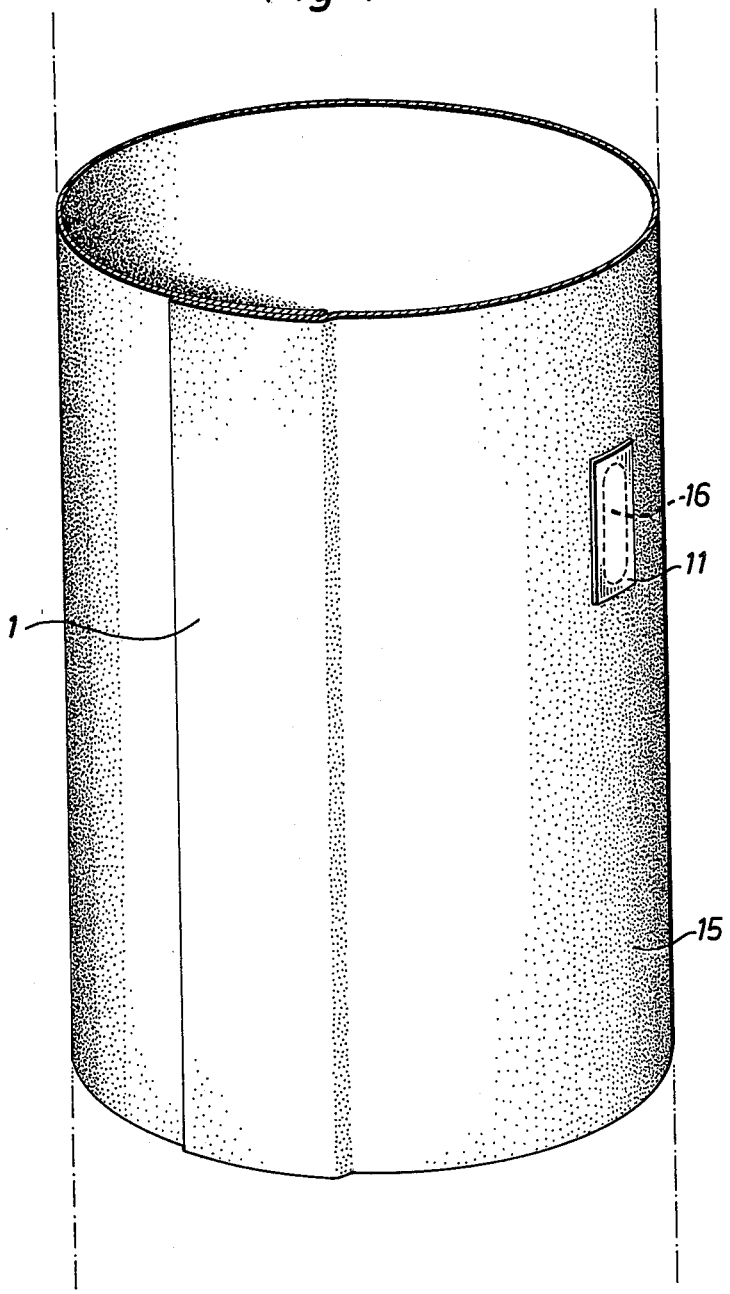

The present invention relates to a parallelepipedic packing container of the type which is manufactured from a tube of packing material, which tube is filled with contents and is divided into individual packing containers by successive flattenings and transverse sealings of the tube along zones situated at a distance from one another within which the packing material is arranged so that it lies inside against inside, and that the packing containers are separated from the tube by cuts in the said zones, together with a method for the manufacture of the packing container.

The invention relates in particular to parallelepipedic packing containers of the type which is manufactured from flexbile packing material, such as plastic film or laminate of plastics and paper or of aluminium, plastics and paper.

It is an object of the invention to provide a suggestion for a packing container of greater rigidity thatn that used to-day, which means that a thinner packing material, and hence also a cheaper packing material, could be used without any risk of deformation of the package when the same is handled.

The invention proposes a parallelepipedic packing container which is formed from a web of packing material and is adapted so that it can be emptied by pouring the contents from the one end surface of the packing container, whilst at least two of the side walls of the packing container, which are substantially at right angles to the said end surface of the package, are stiffened or reinforced in that along a substantial area along the side walls overlapping layers of the material are arranged from which the package has been made. A container in accordance with the invention can be manufactured by the forming of a web of packing material to a tube, which is filled with the intended contents, e.g. a liquid, formed with the help of suitable devices and finally divided from the tube with the help of transverse seals, whereupon the packages thus formed are separated from each other by means of cuts in the transverse sealing zones. A method for the manufacture of packages of this type is specified in British patent specification No. 1,012,867 (Swedish Pat Nos. 324.132 and 324.986).

In the practical realization of the abovementioned method for the purpose of manufacturing packages in accordance with the invention, the tube forming device and the package forming device are arranged so that the longitudinal sides of the packing container form right angles to the tube axis, and consequently that the transverse sealing zones of the tube will extend along the central parts of two opposite side walls in the finished package, whilst the longitudinal, tube-forming seal, which is preferably of the overlap type, extends at least partly around three side walls of the finished package.

It is a characteristic feature of the invention that the longitudinal fins along the side walls of the packing containers formed during the sealing are cut through when adjacent packing containers are separated from one another, whereupon the fins so formed are folded down against and sealed to the side walls of the packing container for the purpose of contributing to the stiffening and reinforcement of the same, at the same time as the negative effects of projecting sealing fins are eliminated. To ensure that this result is obtained, the folded down fins are given an appreciable width, which amounts to one half of the width of the side wall of the container against which the fin is folded down and fixed.

The flattening zone from which the fins are obtained is formed in that the tube of packing material, which may have a circular or elongated cross-section, is flattened between sealing jaws and that the packing material pressed together by flattening, which is brought into contact inside to inside, is heat-sealed to each other along two narrow sealing regions close to the limiting edges or base lines of the flattening zone, whilst the portions of the flattening zone in between remain non-sealed. When a formed package is to be separated from the adjacent package or from the tube, one layer of material in the double-walled, non-sealed flattening zone is cut through quite closely to one of the said sealing regions whilst the opposite layer of material is cut through substantially closely to the opposite sealing region, the parts of the sealing fin situated between the sealing regions being in principle separated from one another. However, since in order to separate the packages the fin must also be cut off between the said cuts which both go through one layer of material, a cut must be arranged from the one side of the fin which goes through the one material layer between the two first cuts in the middle of the sealing region. In this manner fins are formed on each package which in principle have single material thickness along substantially the full length of the sealing regions. The fins of substantially single material thickness formed are subsequently folded down against and sealed to adjoining side walls of the packing container, where they form stiffening and reinforcing areas comprising double material thickness, which areas extend over the whole length of the package.

In the forming of the package from a tube, projecting triangular, double-walled lugs are formed at the corners of the package, and these lugs are folded down and sealed against preferably the side walls and one of the end walls of the package respectively, whilst one of the end walls of the package is left completely free and plane. This free, plane end wall is provided appropriately with a pouring hole through which the contents can be emptied out. This pouring hole is sealed with a tear-off strip, which is arranged so that it acts as a seal around the pouring hole, but which can be torn off when the contents are to be made accessible.

Figure 2:
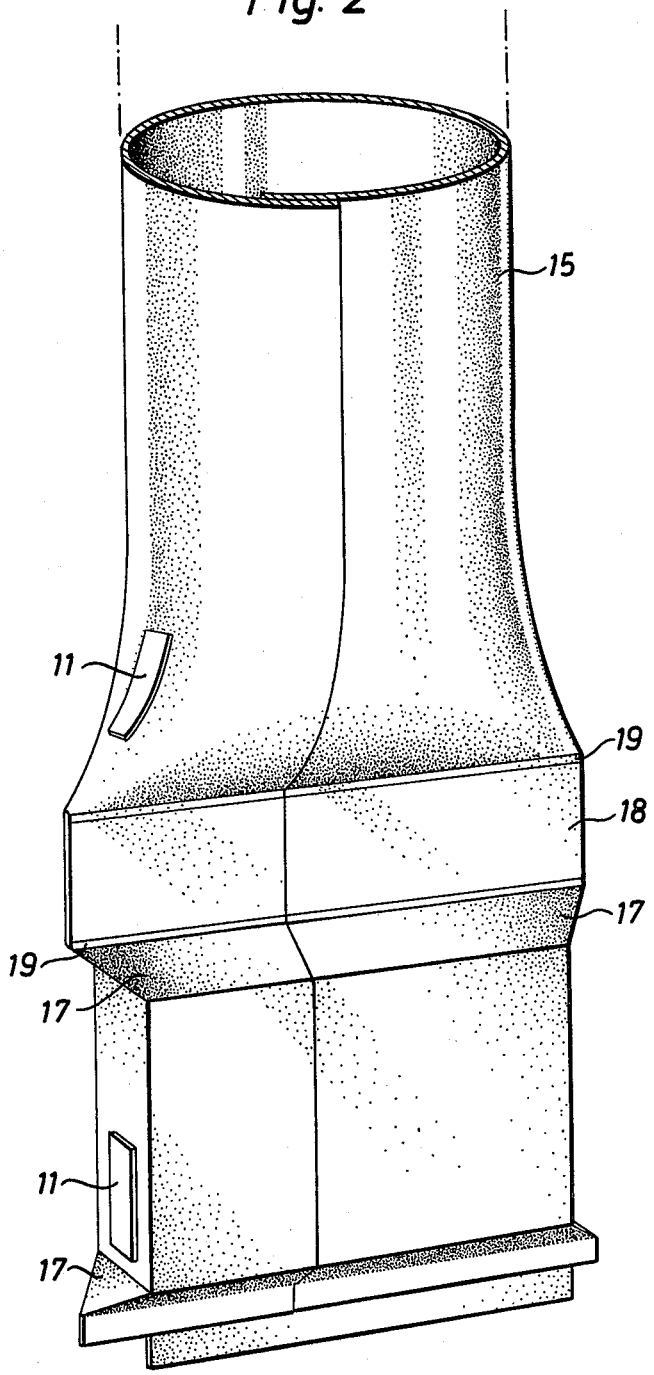
Figure 3:
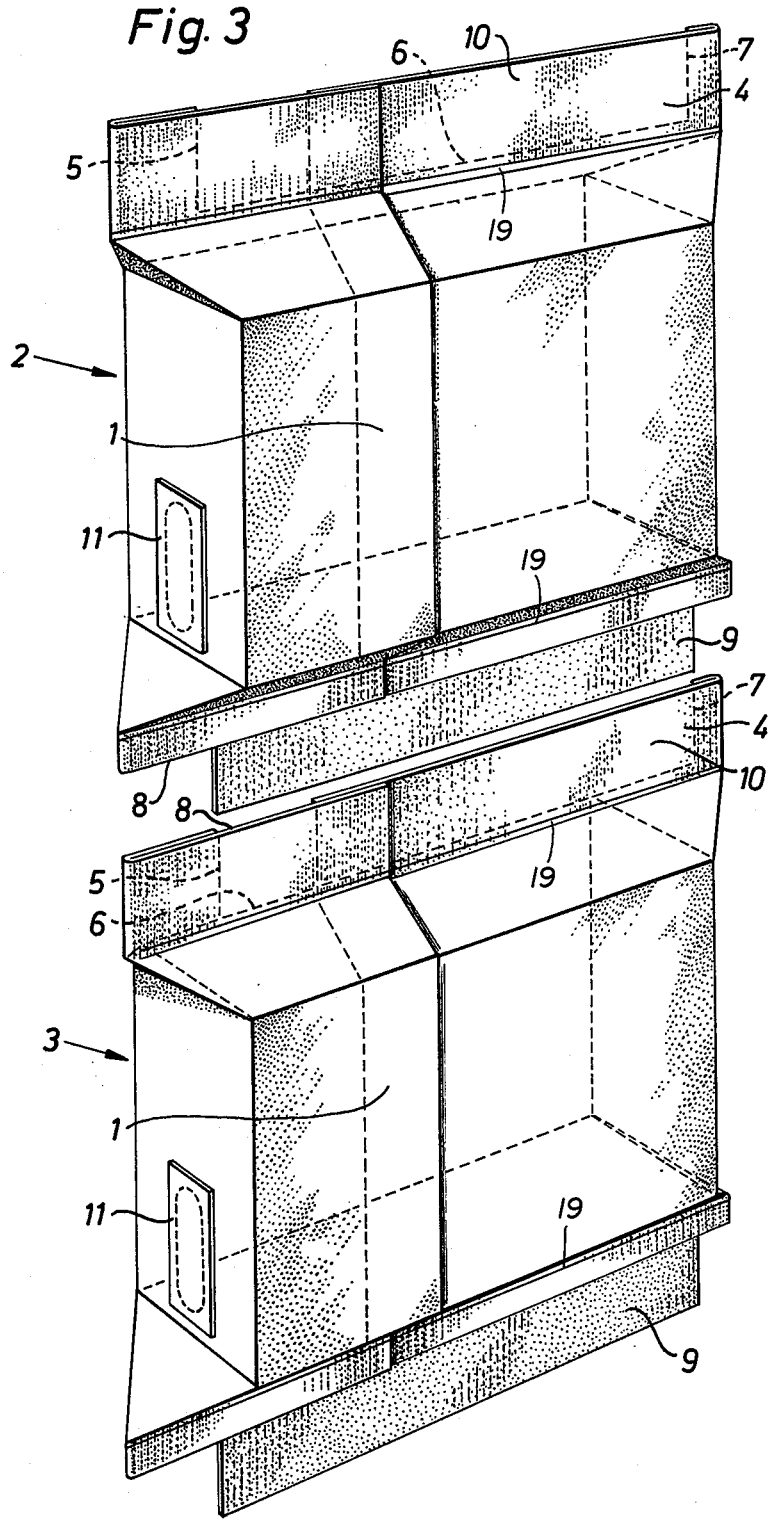
Figure 4:
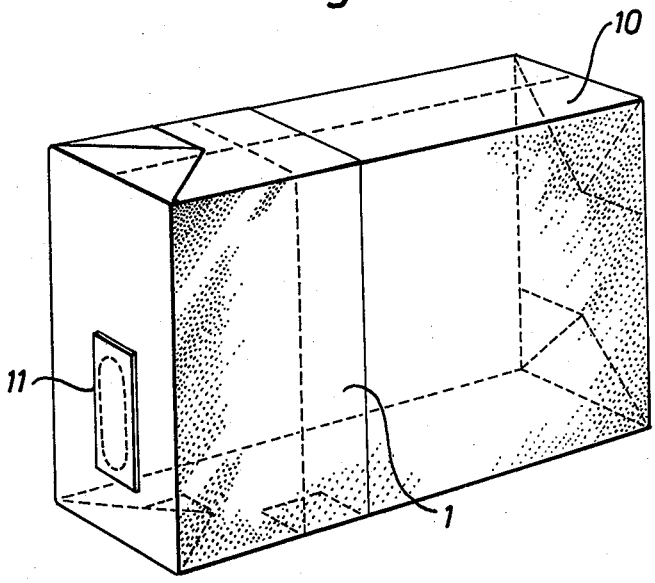

In the following an embodiment of the invention will be described and illustrated with reference to the attached drawing, in which FIG. 1 shows a perspective view of a part of a tube of packing material which is formed by joining together the edge regions of a web in an overlap joint, FIG. 2 shows how the tube in accordance with FIG. 1 is formed to a packing container, FIG. 3 shows a perspective view of two partly formed packing containers in accordance with the invention, which are separated from one another after they have been formed and sealed from a tube of the type which is shown in FIG. 1, and FIG. 4 shows a perspective view of a finished packing container in accordance with the invention.

In accordance with the invention a web of packing material consisting of e.g. a layer of paper with a plastic coating on each side is formed to a tube by causing the edges of the web to overlap one another, whereupon they are heat-sealed to each other. In the present case the overlapping area 1 is of a substantial width, e.g. 30 mm or more, so as to form an effective gripping area and a reinforcement of the side of the package. It is not necessary, however, for the realization of the invention to make the overlap joint so wide, but it is also possible to work with an overlap joint of only a few mm.

The tube formed from the packing material web is filled with contents, e.g. milk, and is formed to parallelepipedic packing containers in a known manner, e.g. in the manner which is described in Swedish Pat. Nos. 324.132 and 324.986. In FIG. 1 is shown a section of a tube 15, which is formed from a packing material web, the end edges of which have been joined together in a longitudinal overlap joint 1. The packing material web, from which the tube 15 is formed, is provided before the tube formation with a punched-out pouring hole 16, which also before the tube formation, is covered over with a tear-off cover strip 11, which is fixed to the packing material in a tight sealing joint around the hole 16.

In FIG. 2 is shown how the tube 15 in a manner known in itself is formed to a parallelepipedic package with the help of a method which e.g. may be of the type described in Swedish Pat. Nos. 324.132 and 324.986. As can be seen from FIG. 2 triangular lugs 17 will be formed at the corner parts of the package formed, which lugs are connected to the flattened part 18, which also extends along the whole side wall of the package. At the edges 19 of the flattened part 18 the packing material pressed together is sealed inside against inside in narrow sealing regions 19, whilst the portion 18, situated in between, is non-sealed. As is evident from FIG. 2, the flattened portion 18 is relatively wide, and the width of the flattened portion 18 is preferably equal in size to half the width of the side wall of the packing container to which the flattened portion is connected.

In accordance with the invention the finished packages are separated from the sealed off tube in a special manner which is characteristic for the invention and which is evident from FIG. 3. The method consists in that in principle the non-sealed portion 18, which is double-walled so that the one wall thickness will be associated with the packing container which is situated above the flattened area, and the other wall thickness will be associated wth the packing container which is situated below the flattened area. This can be brought about by cutting through the non-sealed portion 18 with cuts from both sides of the portion, the one cut being arranged close to the upper sealing region 19 from the one side of the flattened part, whilst the other cut is arranged towards the opposite side of the flattened portion close to the lower sealing region 19. Even if such cuts are carried out, it will not be possible to separate the packages from one another, owing to the fact that they also hang together along the longitudinal edges of the original tube, that is to say the side edges of the flattened portion 18, and it has been found to be appropriate, in the manner as shown in FIG. 3, to provide, in addition to the abovementioned cuts in the flattened region 18, also the cuts 5, 7 from the one side which will then allow the packages to be separated from one another. In FIG. 3 are shown the formed packages 2, 3 separated from one another, the package 2 as well as the package 3 presenting a projecting fin 9 at the bottom whose width is preferably half the width of the package side which is connected to the transverse seal, but, as can be seen from the figure, the fin 9 does not extend to the tips of the triangular lugs 17 but, owing to the arrangement of the cuts 5, 7, the fin 9 is cut off so that it is shorter than the distance between the tips of opposite triangular lugs 17. The sealing regions 19, on the other hand, do extend of course over the whole distance between the tips of the triangular lugs 17 and stretch over the whole length of the side of the package. The upper fins 10 of the packing containers 2, 3 are substantially also of single material thickness, but owing to the transverse cuts 5, 7 mentioned earlier which extend between the cuts 6, 8, which are carried out from opposite sides of the fin 18, the parts of the fin 10 which are situated near the tips of the triangular double-walled panels 17 will have double material thickness. It will readily be understood that the fin 9 fits into the "notch" in fin 10, and, in the manner specified above, wide fins 9, 10 are readily obtained at each of the opposite outside walls of the packing container, which wide fins can be folded down and fixed to the side walls of the packing container in the manner as shown in FIG. 4, a substantial reinforcement of the side walls of the packing container being obtained, whilst at the same time the projecting sealing fins, which are ungainly and in some cases hinder the handling of the packages, will be eliminated, and smooth side walls of the package will be obtained. After the folding in and fixing of the fins 9, 10, the triangular lugs 17 will be folded down in the manner as shown in FIG. 4 against the sides and bottom respectively of the packing container and fixed in this position, a wholly plane upper end surface being obtained on the package, in which upper end surface is provided the pouring hole 16 and the tear-off cover strip 11.It will be clear from the foregoing that the opposed upper and lower surfaces as shown in FIGS. 3 and 4 constitute the opposed side walls fo the final container and that the opposed vertical end walls as shown in FIGS. 3 and 4 constitute the top and bottom of the container.

The stiffening of the side walls of the packing containers is of special value when a package is to be handled in connection with it having to be opened for the contents to be made accessible, since it allows the packing container to be gripped in one hand without any risk of the side wall buckling, and the pouring out of the contents being rendered difficult.

The description of the invention given here is intended merely to illustrate the concept of the invention, and it is possible of course to modify e.g. the folding in of the triangular, double-walled lugs and also the design of the fins within wide limits without thereby departing from the concept of the invention.

We claim:

1. A parallelepipedic packing container formed from a tube of packaging material in which the tube is filled with the desired contents and is then divided into individual interconnected containers by transversely sealing the walls of the tube in face-to-face relation at spaced zones longitudinally of the tube, each zone including a pair of spaced transverse seals and an unsealed portion therebetween, shaping the individual containers into a parallelepipedic form and finally separating the packages one from another by severing the transverse sealing zones between the pairs of transverse seals thereof to form sealing fins along opposed side walls of each container and triangular portions extending beyond the side walls at the top and bottom of each container, said container comprising a parallelepipedic body, sealing fins disposed along two opposite side walls thereof, each fin having a width substantially equal to one-half the width of the side walls and including one of the pair of transverse seals of each sealing zone and a fin-like portion of single thickness of the packaging material projecting from the associated transverse seal, one of said fin-like portions terminating short of the opposed ends of the associated transverse seal, the other of said fin-like portions having a section of single thickness intermediate the opposed ends thereof which section corresponds in size and shape with the fin-like portion of said one of said fin-like portions, the ends of said other fin-like portion beyond the ends of the section of single thickness having a double thickness of packaging material, each of said fin-like portions being folded against and sealed to the associated side wall whereby the stiffness of the side walls of the container is increased to resist buckling when the container is handled.

2. A parallelepipedic packing container as claimed in claim 1 wherein the triangular portion at the end of the said one fin-like portion at the top of the container and including the corresponding end of the associated transverse seal, and the triangular portion at the end of the said other fin-like portion at the top of the container and including the corresponding end of the associated transverse seal are folded down against and sealed to the opposed side walls of the container.

3. A parallelepipedic packing container as claimed in claim 1 wherein the triangular portion at the end of the said one fin-like portion at the bottom of the container and including the corresponding end of the associated transverse seal, and the triangular portion at the end of the said other fin-like portion at the bottom of the container and including the corresponding end of the associated transverse seal are folded down against and sealed to the bottom of the container.

4. A parallelepipedic packing container as claimed in claim 1 and further comprising means for opening said container at the top thereof.

* * * * *